US012274317B2

(12) United States Patent
Tyson et al.

(10) Patent No.: US 12,274,317 B2
(45) Date of Patent: Apr. 15, 2025

(54) CONCEALED CARRY BIB-OVERALLS

(71) Applicants: Eddie Tyson, Dunedin, FL (US); Randi Tyson, Dunedin, FL (US); Dale Cox, Dunedin, FL (US); Louise Cox, Dunedin, FL (US)

(72) Inventors: Eddie Tyson, Dunedin, FL (US); Randi Tyson, Dunedin, FL (US); Dale Cox, Dunedin, FL (US); Louise Cox, Dunedin, FL (US)

( * ) Notice: Subject to any disclaimer, the term of this patent is extended or adjusted under 35 U.S.C. 154(b) by 0 days.

(21) Appl. No.: 17/665,455

(22) Filed: Feb. 4, 2022

(65) Prior Publication Data

US 2023/0248086 A1 Aug. 10, 2023

(51) Int. Cl.
*A41D 13/02* (2006.01)

(52) U.S. Cl.
CPC ..... *A41D 13/02* (2013.01)

(58) Field of Classification Search
CPC ..... A41D 13/02; A41D 27/20
See application file for complete search history.

(56) References Cited

U.S. PATENT DOCUMENTS 1,134,458 A * 4/1915 Jones ..... A41D 27/20 2/251
1,345,779 A * 7/1920 Hosmer ..... A41D 13/02 2/79
1,785,580 A * 12/1930 Fellroth ..... A41D 13/02 2/237
1,827,585 A * 10/1931 Kautz ..... A41D 13/02 2/247
1,998,739 A * 4/1935 Sanderson ..... A41D 13/02 2/227
2,132,668 A * 10/1938 Wittmack ..... A41D 13/02 D2/743
2,280,921 A * 4/1942 La Vigne ..... A44B 11/18 24/197
2,312,177 A * 2/1943 Lester ..... A41D 27/20 D2/857
2,460,228 A * 1/1949 Hoffman ..... A44B 11/00 24/320
2,482,349 A * 9/1949 Lang ..... A41D 13/02 D2/743
2,492,499 A * 12/1949 Pollock ..... A41D 13/02 2/253
2,501,111 A * 3/1950 Walker ..... A41D 13/02 2/231

(Continued)

*Primary Examiner* — Richale L Quinn

(57) ABSTRACT

Concealed carry bib-overalls for providing concealed pockets for placing firearms for concealed carry transport. The concealed carry bib-overalls may comprise a pair of overalls and one or more concealed pockets. The pair of overalls may be a garment comprising a bib which is adapted to extend vertically in front of a user's abdomen. The bib may be held upright by suspenders. The suspenders may be adapted to couple to the top of the bib after passing over a user's shoulders. The concealed pockets may be located on the rear of the bib where the concealed pockets may be hidden from view. The one or more concealed pockets may be adapted to conceal a handgun. A user may produce the handgun from within the concealed pockets by releasing a gap fastener and extracting the handgun through one or more access gaps.

15 Claims, 4 Drawing Sheets

(56) References Cited

U.S. PATENT DOCUMENTS 2,507,382 A * 5/1950 Norvich ..... A41D 11/00 D2/743
2,694,810 A * 11/1954 Williamson ..... A41D 13/02 D2/743
2,721,326 A * 10/1955 Williamson ..... A41D 13/02 2/79
4,262,832 A * 4/1981 Perkins ..... F41C 33/0227 224/605
5,465,429 A * 11/1995 Rogers ..... F41H 1/02 2/311
5,511,246 A * 4/1996 Farkas ..... A41D 13/02 2/237
6,131,198 A * 10/2000 Westrick ..... F41C 33/048 2/2.5
7,631,368 B1 * 12/2009 Samson ..... F41C 33/02 2/77
7,743,430 B2 * 6/2010 Jennings ..... A45C 1/04 2/94
9,414,631 B2 * 8/2016 Schrimpf ..... A41D 27/205
9,557,139 B1 * 1/2017 Miner ..... A44B 18/0073
10,066,901 B2 * 9/2018 Dahl ..... F41C 33/0236
10,168,122 B1 * 1/2019 Cash ..... F41C 33/048
2009/0025117 A1 * 1/2009 French ..... F41C 33/00 224/230
2012/0317701 A1 * 12/2012 Bohun ..... A41D 27/20 2/251
2015/0089708 A1 * 4/2015 Trevino ..... A41D 13/0012 2/69
2015/0144673 A1 * 5/2015 Dahl ..... F41C 33/0236 224/587
2015/0342272 A1 * 12/2015 Bonime ..... A41D 13/02 2/230
2016/0324236 A1 * 11/2016 Schrimpf ..... A41D 27/20
2017/0013891 A1 * 1/2017 Olvera ..... A41D 13/02
2017/0234647 A1 * 8/2017 Schweitzer ..... A45C 3/06 224/587
2018/0292167 A1 * 10/2018 Rocque ..... A41D 13/0012
2020/0121000 A1 * 4/2020 Wood ..... A41D 13/012
2020/0348107 A1 * 11/2020 McFadden ..... F41C 33/0227
2022/0187044 A1 * 6/2022 Calvo ..... A41D 13/0012
2022/0395034 A1 * 12/2022 Tycon ..... A45F 5/021

* cited by examiner

CONCEALED CARRY BIB-OVERALLS

FIELD OF THE INVENTION

This invention relates to bib-overalls. More particularly, it relates to bib-overalls having concealed carry pockets.

BACKGROUND

Overalls, also called bib-and-brace overalls or dungarees, are a type of garment usually used as protective clothing when working. The garments are commonly referred to as a "pair of overalls" by analogy with "pair of trousers".

Overalls were originally made of denim, but they can also be made of corduroy or chino cloth. Overalls were invented in the 1890s by Levi Strauss and Jacob W. Davis at Levi Strauss & Co., but they went through an evolution to reach their modern form. Initially only used for protective clothing in work settings, they have become a garment of high fashion as "potential cult items". Overalls have been trending recently and have been prevalent in streetwear. Many high fashion brands have released their own spin on overalls.

The exact beginnings of the wearing of overalls are unclear, but they are mentioned in literature as early as 1776 as protective working garments commonly worn by slaves.

The first evidence of overalls being mass-produced are those made by Levi Strauss and Jacob Davis in the 1890s. The first "jeans" they invented were actually overalls ("waist overalls" or "waist-high overalls"), consisting of suspenders attached to denim pants with buttons but with no top part with a bib. From the beginning, denim overalls were popular workers' garments due to their durability. In fact, Levi, Strauss & Co.'s slogan in the 1880s-1890s was "Never Rip, Never Tear". In 1911, Harry David Lee made the first bib-overalls, made of pants with pockets with a bib and straps over the shoulders. In 1927, Lee's developed a "hookless fastener" and created "buttonless" overalls. Zippers replaced buttons. Soon after, suspender buttons were traded in for belt loops to attach over-the-shoulder straps.

Current bib-overalls do not have the design consisting of pockets that are conceal as part of the bibs for use of carrying items needing to be hidden from the view of others.

Accordingly, and in light of the foregoing, it would be desirable to have bib-overalls with one or more concealed pockets as part of the bib-overalls. Having the pockets hidden from the view of others is most desirable. The concealed pockets could be used to carry guns or other items needing to be hidden with quick access to the pockets.

DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
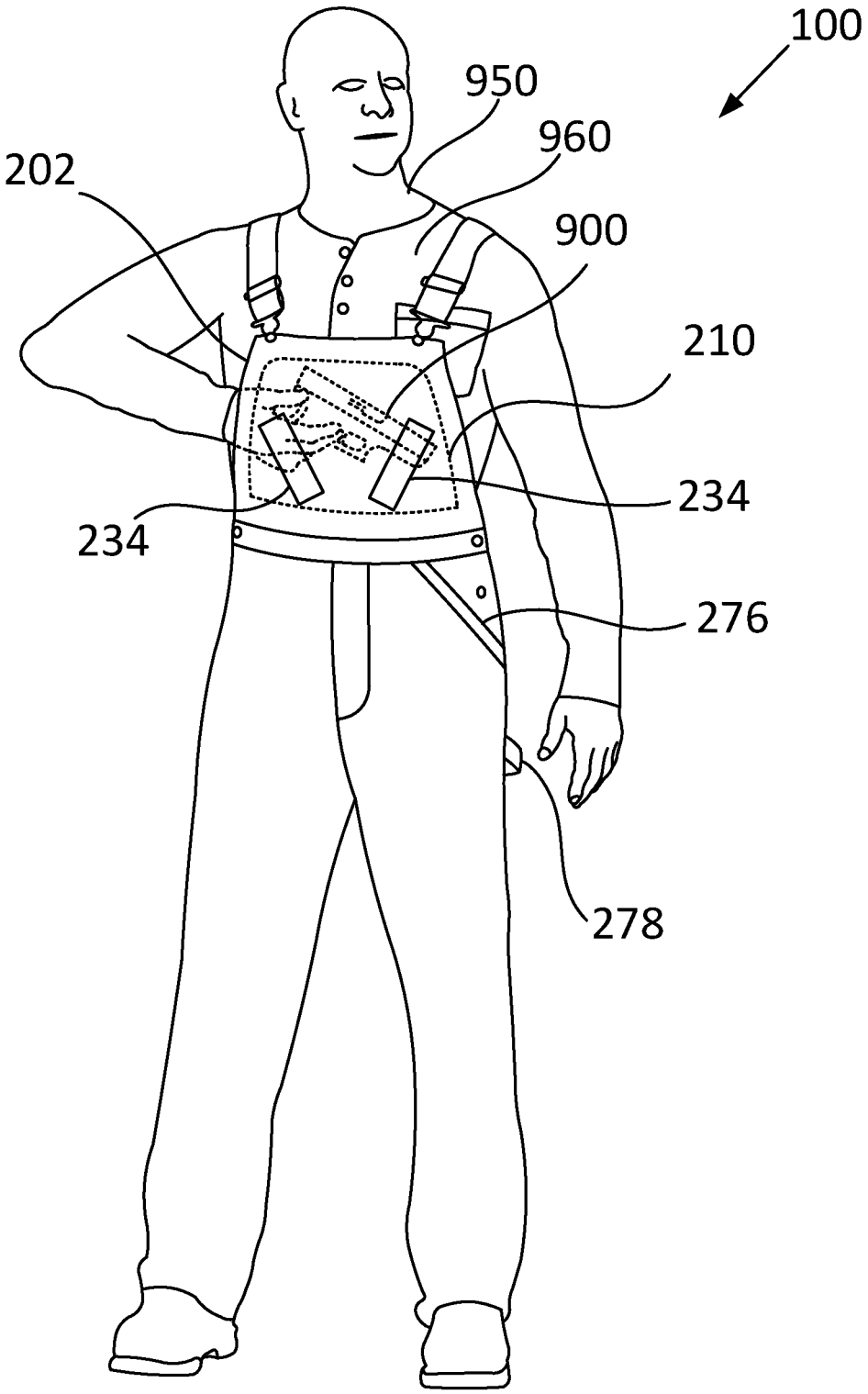
FIG. 1 is an isometric view of concealed carry bib-overalls 100, according to an embodiment of the present invention.
Figure 2:
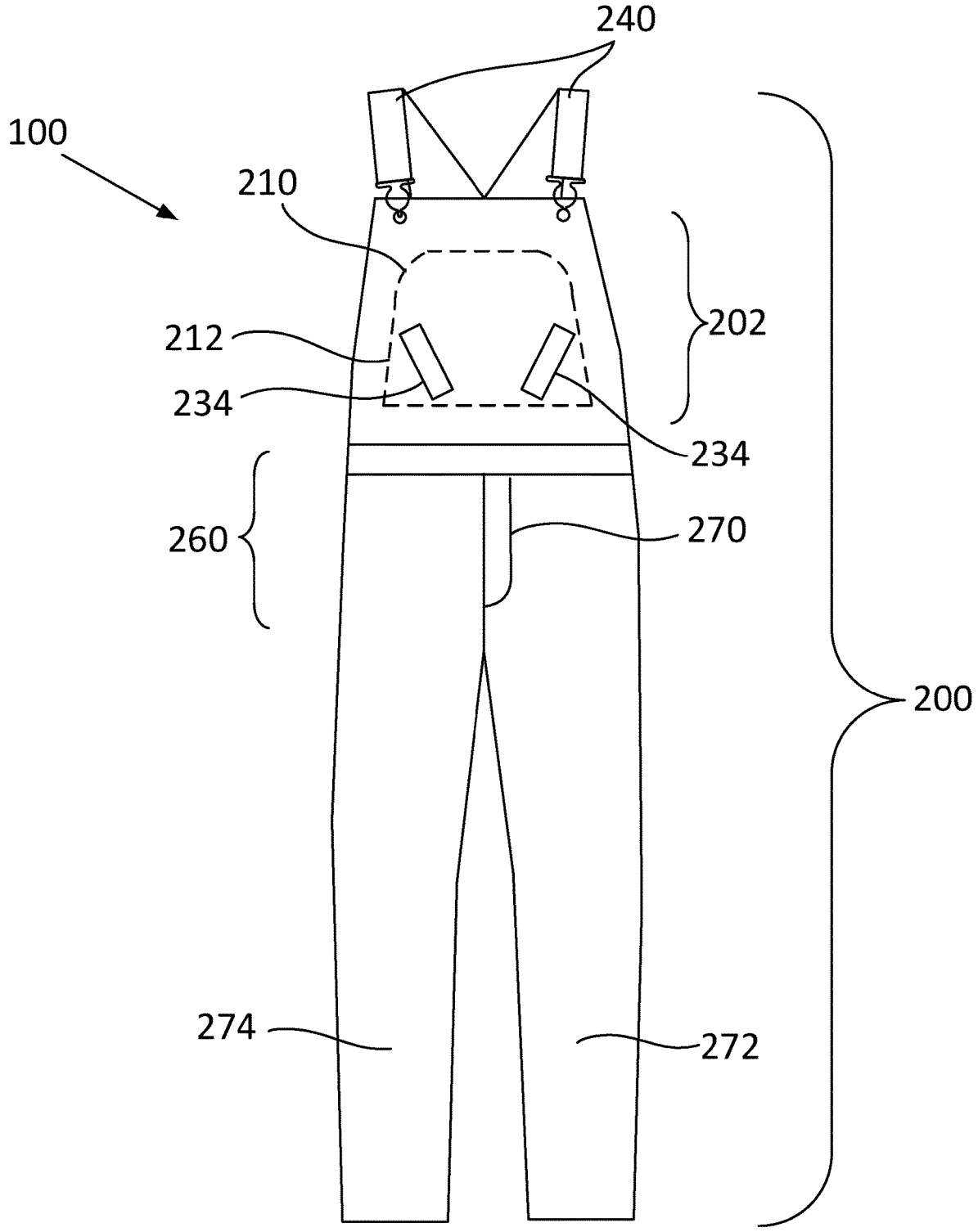
FIG. 2 is a front view of concealed carry bib-overalls 100, according to an embodiment of the present invention.
Figure 3:
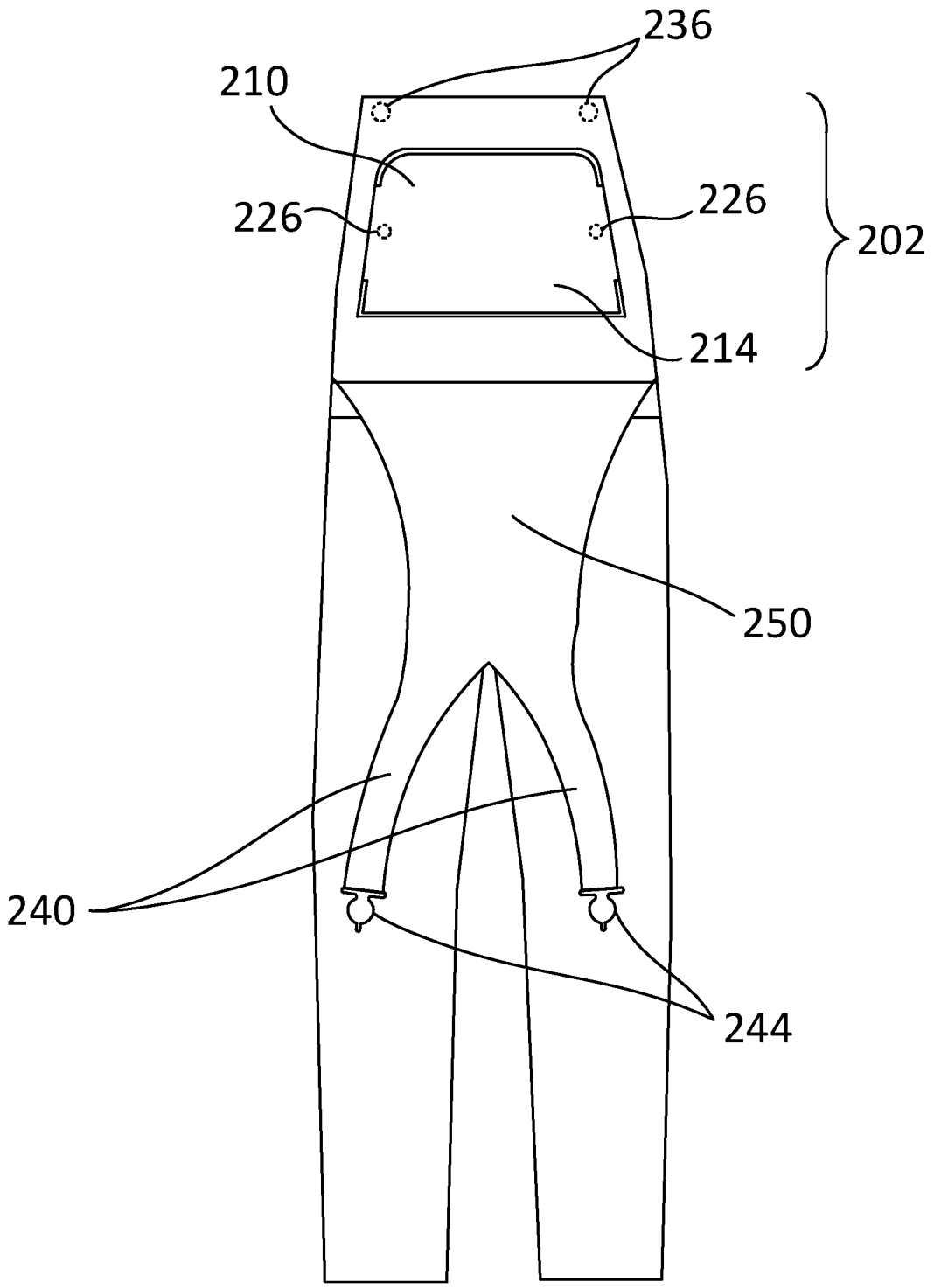
FIG. 3 is a rear view of concealed carry bib-overalls 100, according to an embodiment of the present invention illustrating a concealed pocket with the back panel dropped to show the pocket; and, FIG. 4 is a rear detail view of concealed carry bib-overalls 100, according to an embodiment of the present invention and illustrating the left side of a concealed pocket being pulled open.
Figure 4:
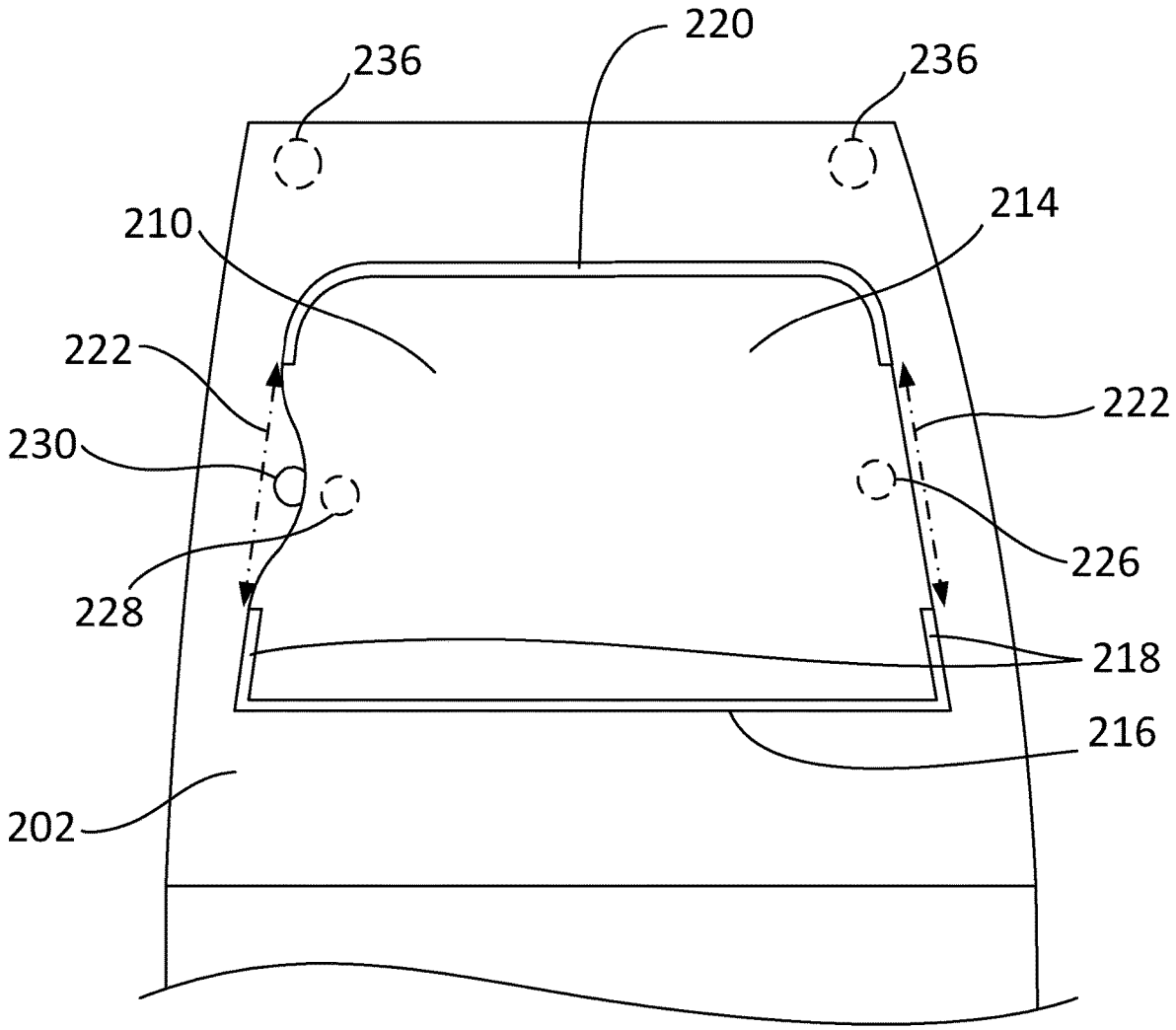

100 concealed carry bib-overalls
200 pair of overalls
202 bib
210 concealed pocket
212 individual concealed pocket
214 fabric panel
216 bottom seam
218 side seam
220 top seam
222 access gap
226 gap fastener
228 hook portion
230 loop portion
234 magazine pocket
236 suspender coupler
240 suspenders
244 dungaree clip
250 back panel
260 waist section
270 flap
272 left leg
274 right leg
276 outer pocket
278 tool loop
900 handgun
950 user
960 user's shirt

DESCRIPTION OF THE INVENTION

The present invention is directed to concealed carry bib-overalls (herein described as the "invention") 100. The invention 100 may comprise a pair of overalls 200 and one (1) or more concealed pockets 210. The pair of overalls 200 may be a garment comprising a bib 202 which is adapted to extend vertically in front of a user's abdomen. The bib 202 may be held upright by suspenders 240. The suspenders 240 may be adapted to couple to the top of the bib 202 after passing over a user's shoulders. The one (1) or more concealed pockets 210 may be located on the rear of the bib 202 where the one (1) or more concealed pockets 210 may be hidden from view. The one (1) or more concealed pockets 210 may be adapted to conceal a handgun 900. A user 950 may produce the handgun 900 from within the one (1) or more concealed pockets 210 by releasing a gap fastener 226 and extracting the handgun 900 through one (1) or more access gaps 222.

The bottom of the bib 202 may be coupled to the pair of overalls 200 at the waist. The top of the bib 202 may detachably couple to the suspenders 240. The bib 202 may be adapted to protect the front of a user's shirt 960 from wear and contamination. Aside from protecting clothing, the user 950 may wear the pair of overalls 200 with the bib 202 solely for appearance reasons.

An individual concealed pocket 212 selected from the one (1) or more concealed pockets 210 may comprise a fabric panel 214 coupled to the rear side of the bib 202. The individual concealed pocket 212 may therefore be located between the bib 202 and the user 950 where the individual concealed pocket 212 may be hidden by the bib 202. The bib 202 may remain accessible by reaching behind the side of the bib 202. The fabric panel 214 may be coupled to the bib 202 along a first subset of the edges of the fabric panel 214 to prevent items from falling out of the one (1) or more concealed pockets 210 and to hold the shape of the one (1) or more concealed pockets 210. The fabric panel 214 may be left detached from the bib 202 along a second subset of the edges of the fabric panel 214 to create the one (1) or more access gaps 222 where items may be removed from the one (1) or more concealed pockets 210.

As a non-limiting example, the fabric panel 214 may be coupled to the bib 202 along a bottom seam 216, along one (1) or more side seams 218, and along a top seam 220. Use of the word seam here should only be construed to be a line along which two (2) pieces of fabric are joined and should not be construed to mean a sewn joint. The fabric panel 214 may be coupled to the bib 202 preferably by sewing the two (2) fabrics together, but other processes of coupling, such as gluing, riveting, stapling, or otherwise joining are also envisioned.

The fabric panel 214 may remain detached from the bib 202 along the one (1) or more access gaps 222. An individual access gap selected from the one (1) or more access gaps 222 may be held closed by the gap fastener 226. As non-limiting examples, the gap fastener 226 may be a zipper, snaps, button, or a hook-and-loop-type fastener (such as Velcro®) that detachably couples the fabric panel 214 to the bib 202. By way of example and not of limitation, a loop portion 230 of the hook-and-loop-type fastener may be coupled to the rear of the bib 202 and a hook portion 228 of the hook-and-loop-type fastener may be coupled to the fabric panel 214 such that the loop portion 230 and the hook portion 228 align and engage when the individual access gap is pressed closed.

In some embodiments, the fabric panel 214 is preferably a double layer of fabric to increase the strength of the individual concealed pocket 212.

The inside of the bib 202 may comprise one (1) or more magazine pockets 234. Each of the one (1) or more magazine pockets 234 shall be preferably sewn, or otherwise joined, to the back side of the concealed pocket 210 against the body. The one (1) or more magazine pockets 234 may be operable to hold an ammunition magazine or any other items that will fit within the one (1) or more magazine pockets 234. In preferred embodiments and methods of use, each concealed pocket 210 is sized to merely enable a weapon to be stored therein.

The upper front of the bib 202 may comprise suspender couplers 236. The suspender couplers 236 may be attachment points for coupling the suspenders 240 to the bib 202. As non-limiting examples, the suspender couplers 236 may be rivets or snaps.

The suspenders 240 may be straps of fabric that couple to the pair of overalls 200 in the rear and are adapted to pass over the user's shoulders to prevent the pair of overalls 200 from falling. As a non-limiting example, the distal ends of the suspenders 240 may comprise dungaree clips 244 in order to couple to the suspender couplers 236 on the bib 202. In some embodiments, the suspenders 240 may be adapted to cross over each over behind the user 950 and may couple to a waist section 260 of the pair of overalls 200. The suspenders 240 may be coupled to each other where they cross.

In some embodiments, the suspenders 240 may couple to a back panel 250. The back panel 250 may be an upward extension of the rear of the pair of overalls 200 above the waist section 260. As a non-limiting example, the back panel 250 may be adapted to cover the center of a user's back.

The waist section 260 of the pair of overalls 200 may be adapted to cover the lower torso, hips, groin, and buttocks of the user 950. The waist section 260 may couple to the bib 202, a left leg 272, and a right leg 274. The waist section 260 may also couple to the suspenders 240, either directly or via the back panel 250.

The waist section 260 may comprise a fly which may be an opening at the crotch of the pair of overalls 200. As a non-limiting example, the fly may be opened while urinating. The fly may comprise a fly fastener to reversibly close the fly. As non-limiting examples, the fly fastener may be a zipper, buttons, or snaps. In some embodiments, the fly may be covered by a flap 270 to hide and/or protect the fly fastener.

The pair of overalls 200 may comprise the left leg 272 and the right leg 274 that are adapted to cover a user's legs. The left leg 272 and the right leg 274 may each be a cylindrical fabric tube that encircles one (1) leg. The tops of the left leg 272 and the right leg 274 may couple to the waist section 260.

The description provide herein is not intended to limit in any way construction techniques that may be employed to make the pair of overalls 200. As a non-limiting example, the description of the left leg 272 and the right leg 274 as cylindrical does not preclude that the left leg 272 and the right leg 274 might be pieced together from fabric panels that meet along an inseam, outseam, other seam line, or combinations thereof.

The pair of overalls 200 may comprise one (1) or more outer pockets 276. The one (1) or more outer pockets 276 may be pouches coupled to the pair of overalls 200 for storing items and may be accessible from the outside of the pair of overalls 200.

The pair of overalls 200 may comprise one (1) or more tool loops 278. The one (1) or more tool loops 278 may be looping straps coupled to the outside of the pair of overalls 200. Each of the one (1) or more tool loops 278 may hold a tool. As a non-limiting example, an individual tool loop may hold a hammer by passing the handle of the hammer through the individual tool loop until the head of the hammer is adjacent the individual tool loop.

The pair of overalls 200 may be made from a durable fabric. As non-limiting examples, the pair of overalls 200 may be made from denim, corduroy, chino cloth, canvas, or combinations thereof.

In use, the pair of overalls 200 may be donned by passing the left leg through the pair of overalls 200 from the top into the left leg 272 and then passing the right leg through the pair of overalls 200 from the top into the right leg 274. The pair of overalls 200 may them be pulled up until the waist section 260 covers the lower torso. Finally, the suspenders 240 may be passed over the user's shoulders and coupled to the top of the bib 202. The handgun 900 may be placed into an individual concealed pocket 212 by releasing a gap fastener 226, passing the handgun 900 into the individual concealed pocket 212 through an individual access gap, and fastening the gap fastener 226. The handgun 900 may be carried, hidden from view, until such time as the handgun 900 is removed by releasing the gap fastener 226 and removing the handgun 900 from the individual concealed pocket 212.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. Concealed carry bib-overalls for providing concealed pockets for firearms to be concealed within, the concealed carry bib-overalls consisting of:

a pair of overalls, the overalls having a bib, wherein the bib being adapted to extend vertically in front of a user's abdomen, wherein the bib has a bottom, wherein the bottom of the bib is coupled to the pair of overalls at a waist of the pair of overalls, wherein the bib has an upper front, wherein the upper front having one or more suspender couplers, wherein the bib further has one or more magazine pockets;

one or more concealed pockets, wherein the concealed pockets has a gap fastener, wherein at least one of the concealed pockets has a fabric panel, the fabric panel coupled to the rear side of the bib, wherein when the concealed pocket has a handgun and the user desires to pull the handgun, the gap fastener is released and the handgun is extracted through one or more access gaps of the concealed pockets, the concealed pockets being coupled to a rear of the bib of the concealed carry bib-overalls wherein the concealed pockets are hidden from view;

a set of suspenders, wherein the suspenders being coupled to a top of the bib of the concealed carry bib overalls after passing over shoulders of a user.

2. The concealed carry bib-overalls according to claim 1, wherein the one or more concealed pockets being configured to hold a handgun.

3. The concealed carry bib-overalls according to claim 1, wherein the top of the bib being detachably coupled to the suspenders.

4. The concealed carry bib-overalls according to claim 1, wherein the fabric panel being coupled to the bib along a first subset of edges of the fabric panel.

5. The concealed carry bib-overalls according to claim 1, wherein the fabric panel being coupled to the bib along a bottom seam and along one or more side seams and along a top seam by a coupling device.

6. The concealed carry bib-overalls according to claim 4, wherein the coupling device is a sewing thread.

7. The concealed carry bib-overalls according to claim 4, wherein the coupling device is a hook and loop fastener.

8. The concealed carry bib-overalls according to claim 1, wherein the fabric panel is a double layer of fabric.

9. The concealed carry bib-overalls according to claim 1, wherein the magazine pockets being sewn to the rear of the bib.

10. The concealed carry bib-overalls according to claim 1, wherein the magazine pocket being operable to hold an ammunition magazine.

11. The concealed carry bib-overalls according to claim 1, wherein the suspender couplers being a point of be attachment points for suspenders.

12. The concealed carry bib-overalls according to claim 11, wherein the suspenders being made of a fabric material.

13. The concealed carry bib-overalls according to claim 11, wherein the suspenders having a distal end, wherein the distal end has a dungaree clip.

14. The concealed carry bib-overalls according to claim 13, wherein the distal end of the suspenders being coupled to the suspender couplers of the bib.

15. The concealed carry bib-overalls according to claim 1, wherein the overalls being made of a denim fabric.

* * * * *